US011213847B1

(12) United States Patent
Olsen et al.

(10) Patent No.: US 11,213,847 B1
(45) Date of Patent: Jan. 4, 2022

(54) COVER FOR SPRAY A GUN

(71) Applicants: Chris Olsen, Providence, RI (US); Eric Olsen, Providence, RI (US)

(72) Inventors: Chris Olsen, Providence, RI (US); Eric Olsen, Providence, RI (US)

( * ) Notice: Subject to any disclaimer, the term of this patent is extended or adjusted under 35 U.S.C. 154(b) by 0 days.

(21) Appl. No.: 16/949,374

(22) Filed: Oct. 27, 2020

(51) Int. Cl.
*B05B 15/16* (2018.01)
*B05B 7/24* (2006.01)
*B05B 15/62* (2018.01)

(52) U.S. Cl.
CPC ..... *B05B 15/16* (2018.02); *B05B 7/2402* (2013.01); *B05B 15/62* (2018.02)

(58) Field of Classification Search
CPC ..... B05B 15/16; B05B 15/60; B05B 15/62; B05B 6/2402; B08B 3/026–028
USPC ..... 239/288; 150/161
See application file for complete search history.

(56) References Cited

U.S. PATENT DOCUMENTS 2,132,570 A * 10/1938 Leone ..... B23K 9/28 2/17
2,337,767 A * 12/1943 Paul ..... A61F 13/104 2/17
4,651,929 A * 3/1987 Kranzle ..... B05B 9/01 239/288
4,879,847 A 11/1989 Butzen et al.
5,025,970 A 6/1991 Andersen et al.
5,823,237 A * 10/1998 Alvern ..... B67D 7/421 141/392
5,862,989 A * 1/1999 Cirillo ..... B05B 15/50 239/288
6,173,500 B1 1/2001 Feldmann
6,860,342 B1 3/2005 Wu et al.
2004/0050964 A1* 3/2004 Wong ..... A61D 7/00 239/337
2012/0240301 A1* 9/2012 Gustafsson ..... F16P 1/06 2/16
2014/0190717 A1 7/2014 Simpson
2016/0031695 A1* 2/2016 Hecht ..... A61L 2/00 422/24
2016/0271782 A1* 9/2016 Piritidis ..... B25C 1/06
2020/0108410 A1* 4/2020 Buttram ..... B05B 15/62
2021/0046492 A1* 2/2021 Becker ..... B05B 15/63
2021/0197220 A1* 7/2021 Shultz ..... B05B 9/01

* cited by examiner

*Primary Examiner* — Joseph A Greenlund
(74) *Attorney, Agent, or Firm* — Keeley DeAngelo LLP; W Scott Keeley

(57) ABSTRACT

An apparatus is disclosed for covering an airless spray gun for the purpose of protecting the gun while preventing unintended triggering. Protecting the gun prolongs the life of the tool while preventing unintended triggering helps prevent injection injuries. In one embodiment a semi-rigid elastomeric form encloses the top, front, bottom and at least a portion of the sides of an airless spray gun, or air assisted spray gun, while a flexible elastomeric material covers a significant portion of the sides of the tool.

6 Claims, 4 Drawing Sheets

COVER FOR SPRAY A GUN

TECHNICAL FIELD

The present disclosure relates generally to covers for gun-shaped tools and more particularly to removable, protective covers for airless spray guns.

BACKGROUND

Airless spray guns operate between 2,100 and 51,700 kPa (kilopascals) or 300-7,500 psi (Pounds per Square Inch). Airless spray guns are commonly used to apply industrial coatings like those used for chemical and marine coatings and linings. Advantages of airless spray include proper penetration into crevices, uniform coating, and proper adhesion to the painted surface. Various types of pumps are used to provide paint to the gun at a constant pressure including pneumatic, hydraulic or electric. Airless spray equipment tends to be expensive and the useful life of a spray gun may be prolonged if the gun is protected from overspray and damage from dropping.

Air assisted airless spray guns use a combination of air pressure and fluid pressure between 2,100 and 20,700 kPa (kilopascals) or 300-3,000 psi (Pounds per Square Inch). Air assisted equipment provides high transfer and high application speed. Fluid pressure from an airless pump and compressed air is introduced into the spray at the gun tip to create a fine atomization of the sprayed material.

Spray guns have a handle through which fluids pass to a nozzle or spray gun tip. The spray is controlled by a control mechanism, commonly a trigger. Devices are commonly provided for the adjustment of the nozzle to control the volume and shape of the spray.

The high pressure involved in airless spraying, and air assisted spraying, can result in serious injury such as injection injuries when paint is accidentally ejected from the spray gun nozzle into one's hand or other body part. Injection injury is caused by high-pressure injection of oil, grease, diesel fuel, gasoline, solvents or even water or air into the body. Airless paint sprayers are one of the most common causes of accidental injection injury. Even initial injuries that seem minor can have serious repercussions leading to amputation or even death. Preventing accidental triggering of a spray gun is a primary method for preventing accidental injection injuries.

An elastomer is a polymer with both viscosity and elasticity, also referred to as viscoelasticity. Castable elastomers are rubber-like materials that can be formed in an injection molding process. Some examples of castable elastomers include polybutadiene, butyl rubber, silicone rubber, fluorosilicone rubber, and ethylene-vinyl acetate.

Co-molding of castable elastomers involves inserting a finished part into a second mold and then molding a second elastomer over the first part. Co-molding allows for seamless joints between different materials or between materials of different hardness.

The shore durometer scale is a means for measuring the hardness of a material and is typically used to determine the harness of elastomers and rubbers. Some examples of shore durometer hardness measurements include: chewing gum Shore-00-20, rubber band Shore-A-25, automotive tire Shore-A-70 and a hard-hat Shore-D-80.

SUMMARY

An apparatus is disclosed for covering an airless spray gun for the purpose of protecting the gun while preventing unintended triggering. Protecting the gun prolongs the life of the tool while preventing unintended triggering helps prevent injection injuries.

In one embodiment a semi-rigid elastomeric form encloses the top, front, bottom and at least a portion of the sides of an airless spray gun while a flexible elastomeric material covers a significant portion of the sides of an airless spray gun. Semi-rigid and flexible elastomeric materials may be co-molded or molded separately and joined by a mechanical joint. In some embodiments the semi-rigid form is of a Shore-Durometer of Shore-A-50-Shore-A-70 while a flexible side portion may be of a Shore-Durometer of Shore-A-20-Shore-A-40.

The following drawings are designed to illustrate rather than define the limits of the invention.

DESCRIPTION

Figure 1:
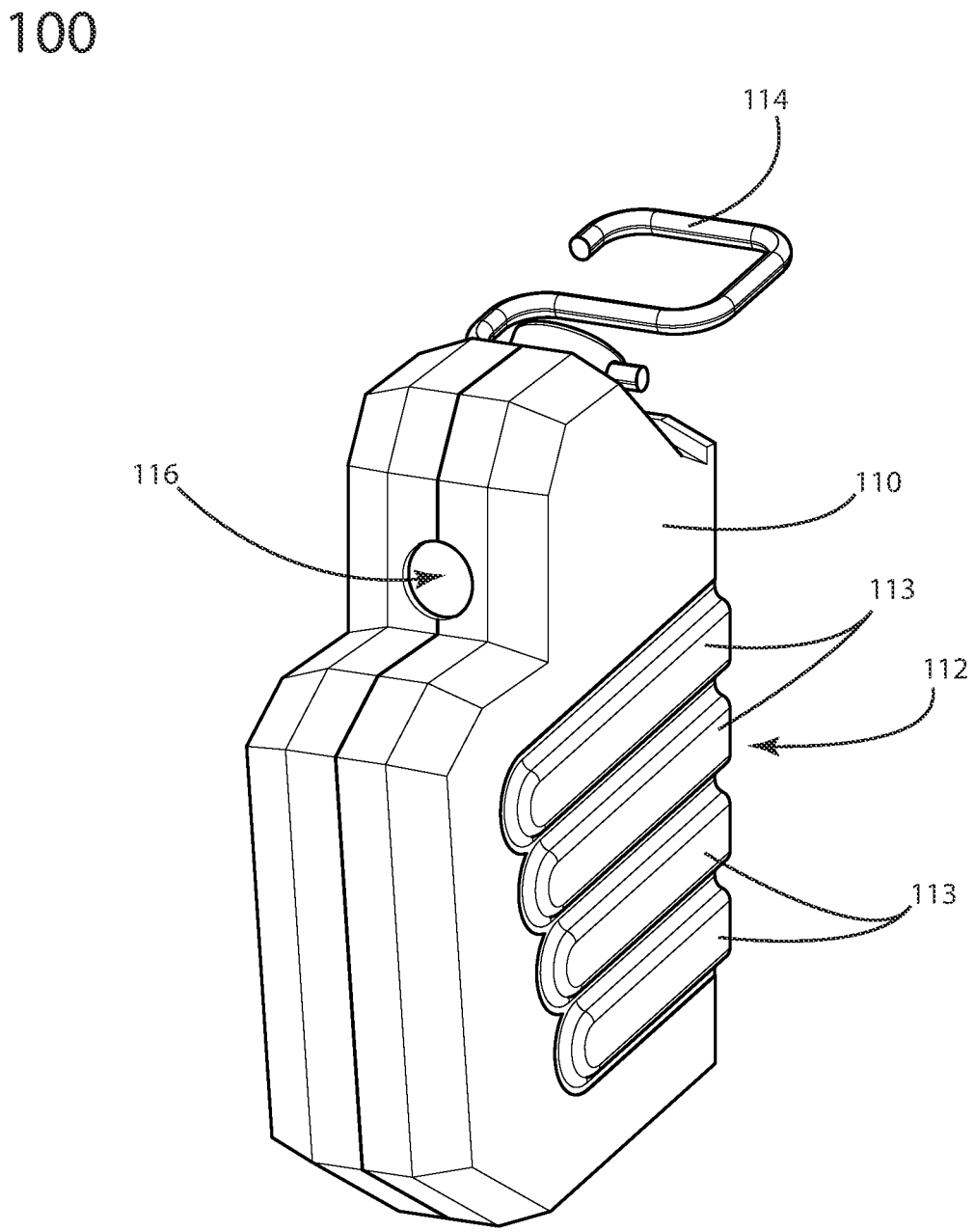
FIG. 1 is a perspective view of the embodiment 100.
Figure 2:
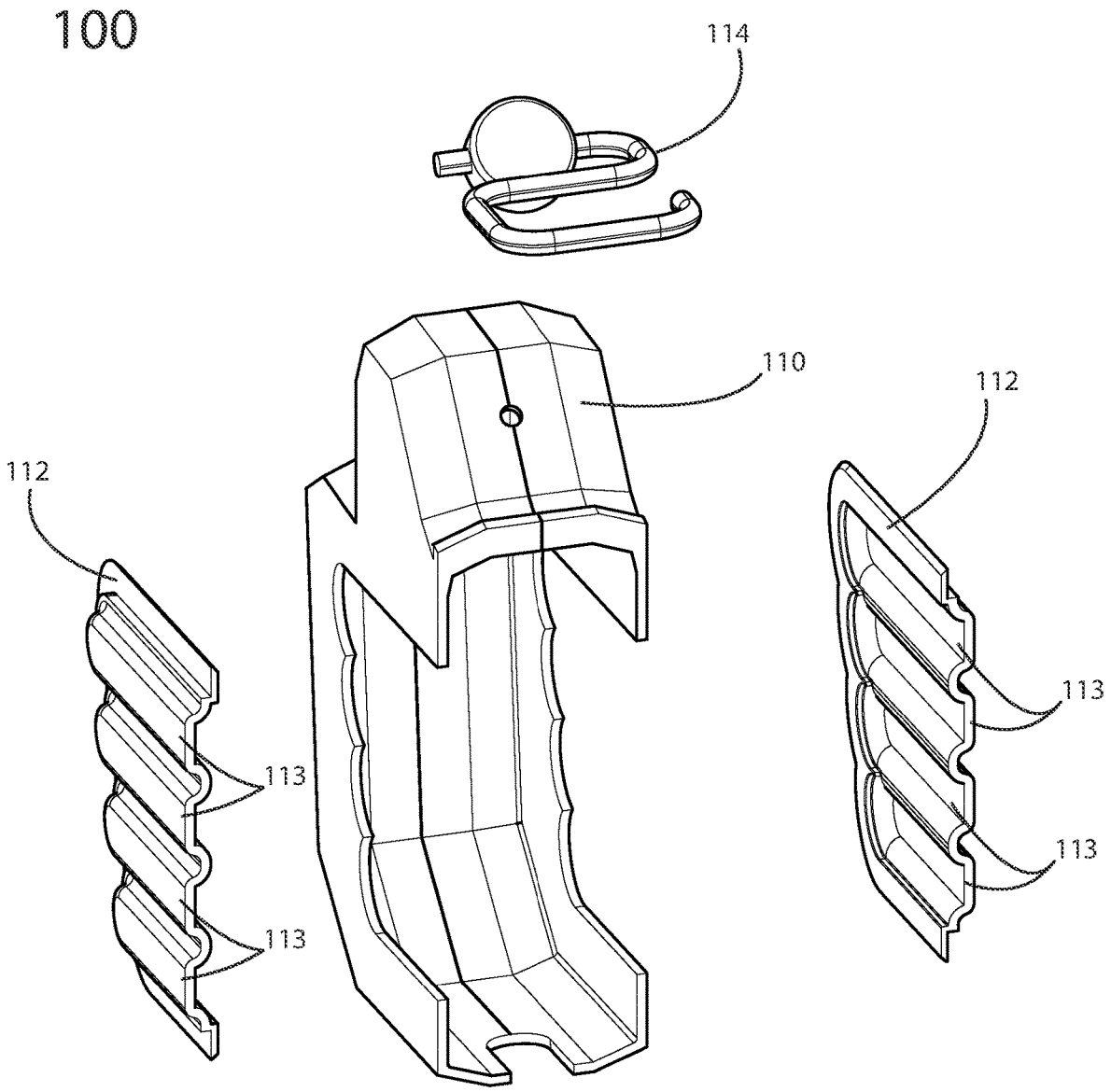
FIG. 2 is a perspective, exploded view thereof.

The present disclosure relates to an apparatus for covering an airless spray gun, also referred to as an airless paint sprayer. Referring to FIG. 1 and FIG. 2, FIG. 1 is a front perspective view of the embodiment 100 and FIG. 2 is an exploded rear perspective view of the embodiment 100. In FIG. 1 and FIG. 2, a cover for an airless paint sprayer has a body 110 that covers the front, top, bottom and a portion of the sides of an airless spray gun, and a flexible panel 112 that covers a portion of the side of an airless spray gun. In some embodiments the body is formed in two symmetrical halves. A hole 116 in the front of the body 110 allows a spray gun tip to pass through. In some embodiments, a hook 114 is attached to the top of the body. A slot, otherwise referred to as an input line 120, accommodates a portion of an airless spray gun 118. The flexible panel 112 can be seen to have ribs 113 that are configured to accommodate a user's fingers.

Figure 3:
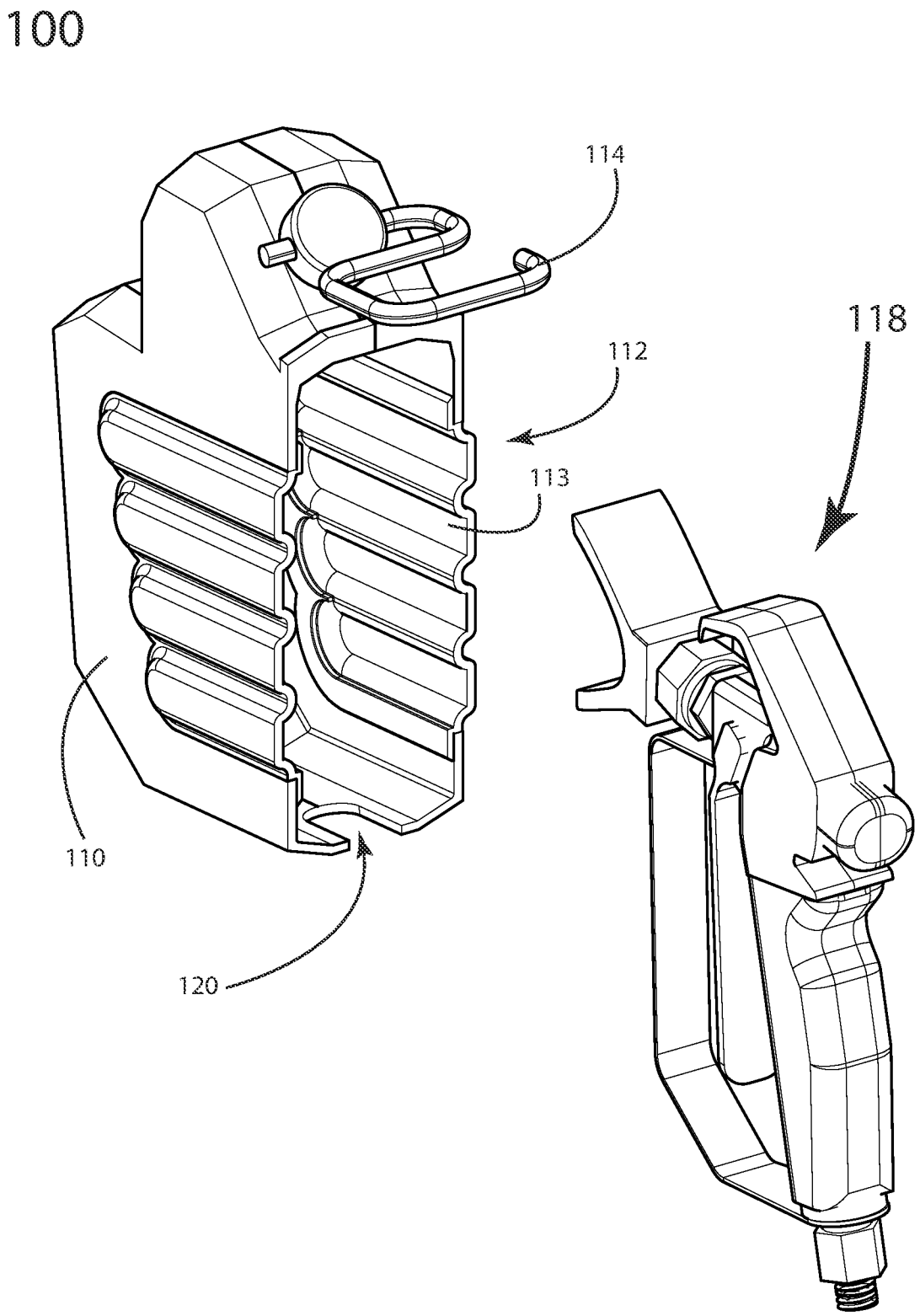
FIG. 3 is a perspective, partial exploded view thereof showing the embodiment and a spray gun.
Figure 4:
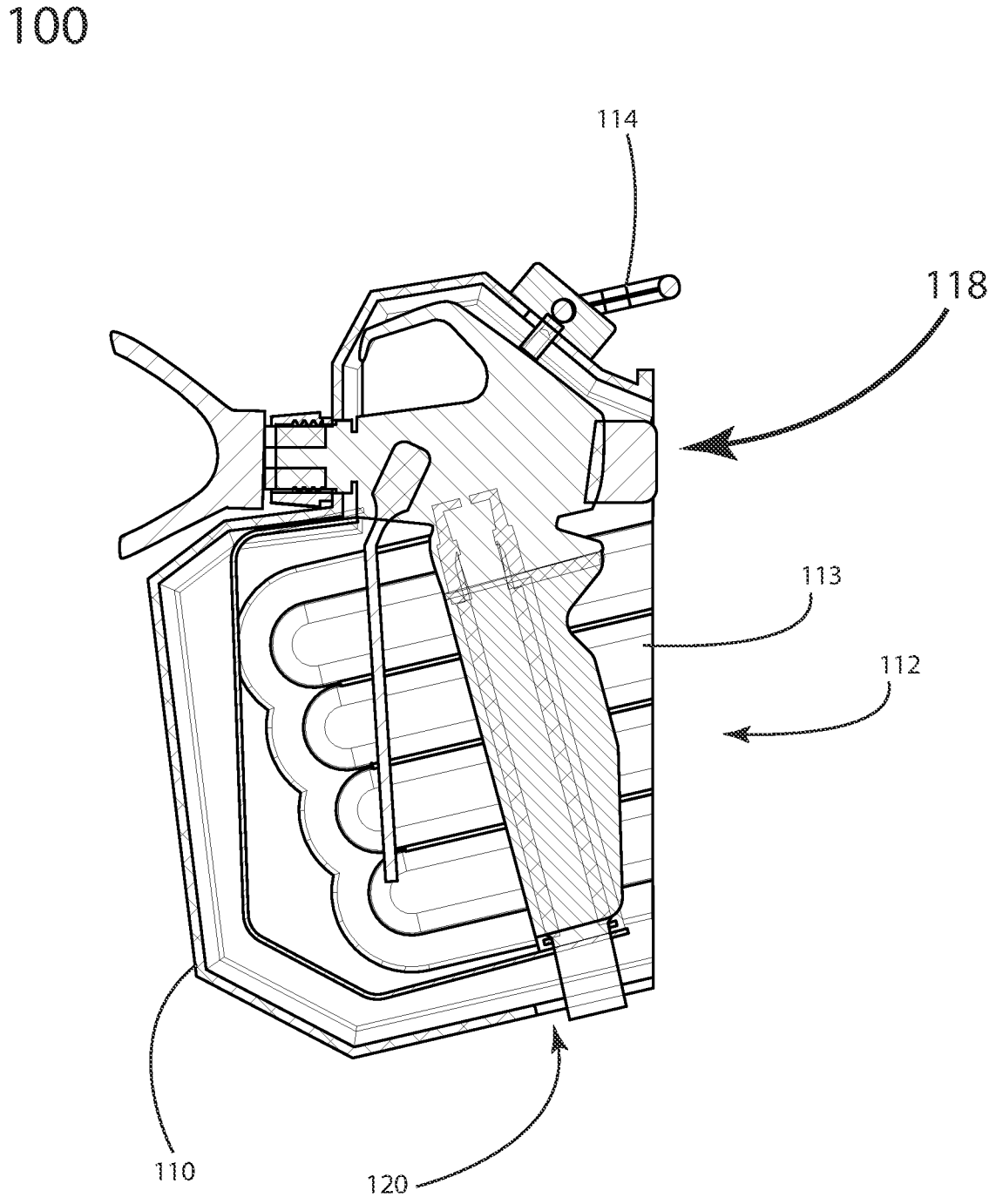
FIG. 4 is a cross section view of the embodiment with a spray gun.

Referring to FIG. 3 and FIG. 4, FIG. 3 depicts an example embodiment 100 shown in a partial exploded view with an airless spray gun 118 while FIG. 4 depicts a cross section view of an airless spray gun 118 inside an example embodiment 100. A body 110 surrounds the front, top, bottom and a portion of the sides of an airless spray gun 118, having a slot 120 to accommodate an input line of the airless spray gun 118. Flexible portions 112 cover the sides of the airless spray gun 118. One skilled in the art understands that a body 110 may be of a relatively high Shore A durometer such as Shore-A 50-Shore-A 80 in order to provide structure to the body 110 and protection for the airless spray gun 118. A relatively firm body 110 also prevents accidental depression of the trigger 122 on the airless spray gun 118. One skilled in the art also understands that a relatively lower Shore-A durometer such as Shore-A 20-Shore-A 40 may be used for flexible portions 112 so that one's hand may easily fit inside the embodiment while gripping the airless spray gun 118. Flexible portions 112 have ribs 113 configured to accommodate a user's fingers.

The invention claimed is:

1. An apparatus for protecting a spray gun comprising:

a substantially hollow form configured to cover at least a portion of a spray gun and configured to expose at least a nozzle and at least one input line of said spray gun; and said substantially hollow form having at least one opening configured to accept a user's hand, and at least one rib configured to accept a user's fingers; and said substantially hollow form having at least a front, a top, a bottom, a left side, and a right side; and said substantially hollow form having at least a semi-rigid portion and a flexible portion; and said semi-rigid portion occupying the top, bottom and front and at least a portion of said right side and said left side of said substantially hollow form; and said flexible portion configured to cover at least a portion of the left side and right side of said substantially hollow form; wherein the semi-rigid portion is configured to protect the gun from overspray, physical damage, and accidental triggering while the flexible portion creates a contiguous surface to protect the spray gun while allowing a user to insert their hands into the substantially hollow form and their fingers in said at least one rib, in order to operate the spray gun.

2. The apparatus of claim 1 wherein;

said semi-rigid portion is an elastomeric polymer having a Shore-A durometer between Shore-A-50 and Shore-A-80; and said flexible portion is an elastomeric polymer having a Shore-A durometer between Shore-A-20 and Shore-A-40.

3. The apparatus of claim 1 wherein;

said nozzle is exposed through a hole in said substantially hollow form; and said at least one input line is exposed through a slot in said substantially hollow form.

4. The apparatus of claim 1 further comprising;

said flexible portion having a plurality of ribs configured to accept fingers of a user's hand.

5. The apparatus of claim 1 wherein;

said flexible portion and said semi-rigid portion are co-molded.

6. The apparatus of claim 1 further comprising a hook fixedly engaged with the semi-rigid portion of said substantially hollow form.

* * * * *